US006032392A

United States Patent [19]

Gordon

[11] Patent Number: 6,032,392

[45] Date of Patent: Mar. 7, 2000

[54] METHOD AND DEVICE FOR CREATING AN ILLUSION OF THICKNESS FROM A FLAT IMAGE

[76] Inventor: Robert Gordon, 42-07 Elbertson St., Apt. 6-G, Elmhurst, N.Y. 11373

[21] Appl. No.: 08/986,819

[22] Filed: Dec. 8, 1997

[51] Int. Cl.[7] ..... G09F 13/32

[52] U.S. Cl. ..... 40/433; 40/577

[58] Field of Search ..... 40/433, 431, 435, 40/474, 473, 495, 577, 579, 580

[56] References Cited

U.S. PATENT DOCUMENTS 1,648,827 11/1927 Schwartz ..... 40/577
2,069,368 2/1937 Horinstein ..... 40/577

FOREIGN PATENT DOCUMENTS 193467 2/1923 United Kingdom ..... 40/577

*Primary Examiner*—Cassandra H. Davis

*Attorney, Agent, or Firm*—Michael I. Kroll

[57] ABSTRACT

A method and apparatus for producing an illusion of depth from a flat image. The apparatus includes a plurality of sheets, each being at least partially transparent and reflective and a light source. A design media having at least one of relatively thin linear and curvilinear design elements cut therein is positioned between the plurality of sheets and the light source. A frame is provided for holding the plurality of sheets therein and forms a slot therebehind for holding the design media. When the light source is illuminated an illusion of depth is produced for the at least one of relatively thin linear and curvilinear design elements cut into the design media. A display media including a plurality of color sectors separated by a plurality of sector lines is rotatably positioned between the design media and the light source. The addition of the display media cooperates with the design media to create the appearance of a series of continually undulating colorful surface segments moving along the path of the original design, changing color and length as they move inward toward the center of the display or outward depending on the direction of rotation of the display media.

16 Claims, 12 Drawing Sheets

METHOD AND DEVICE FOR CREATING AN ILLUSION OF THICKNESS FROM A FLAT IMAGE

BACKGROUND OF THE INVENTION

1. Field of the Invention

The present invention relates in general to a method and device for producing a special effect and, more specifically, to a method of producing an illusion of thickness from a flat image viewable with the unaided eye and a device for producing an animated presentation viewable with the unaided eye having an illusion of thickness from the flat image.

2. Description of the Prior Art

Numerous methods and devices for creating an illusion of thickness have been provided in the prior art. For example, one such method and device known popularly as the "infinity mirror" may be used to create an illusion of thickness. This device includes a full mirror having a reflectance approaching 100%, and a partially silvered or transparent mirror having a reflectance of approximately 50% and a transparency as low as 8%. The two mirrors are positioned to extend substantially parallel and spaced from each other to form a gap therebetween. The reflective sides of the two mirrors are also positioned to face each other. When an observer views an illuminated display positioned between the two mirrors through the transparent mirror, an array of singular reflections is observed, separated by equal gaps, which recede and fade away from both the original image and the observer into the depth of the field of view.

In the case of the "infinity mirror", the traditional two mirror arrangement yields a maximum number of visible reflections possible for the type of material used, i.e. adding additional partially reflective surfaces decreases the number of visible reflections produced. This is evident from the graphical representation of FIG. 12. The relatively low transparency/reflectivity ratio of transparent mirrors leaves little light beyond the first reflection for distribution to other reflections thus reducing the ability to produce additional reflections.

Raising the transparency/reflectivity ratio of the mirrors by using glazing material or the equivalent, while increasing the number of sheets used, greatly increases the distribution of light to the increased number of surfaces, thereby generating a greater number of visible reflections. Each reflection in the resulting series of reflections is actually a composite, a superimposition of many singular reflections generated by each additional sheet in a complex way as is illustrated in the graphs of FIGS. 10 and 11. The number of highly visible composite reflections possible under normal viewing conditions, using commercially available lighting, is equal to or greater than the number of sheets used as can be seen from FIG. 12.

FIGS. 10 and 11 illustrate the pattern of incident light vectors of a single sheet screen and a 4 sheet screen, respectively. It can be seen from these figures that two different theoretically infinite series of reflections of the original image result, each reflection spaced at an interval equal to twice the thickness of the sheets in the screen. In the single sheet example shown in FIG. 10, each reflection position contains one reflection while, in the multiple sheet screen illustrated in FIG. 11, each position contains many reflections produced and distributed by each sheet in the screen and superimposed upon one another. This can be verified by tracing and counting the number of vector paths associated with each observer in FIGS. 10 and 11.

A determination of incident light values for each vector presented in the drawings may be made by expressing them in a simplified, idealized form. By ignoring the effects of distance and absorption, each vector can be assumed to be the sum of reflected and transmitted light from vectors immediately preceding them.

For example, the fraction of incident light in the vector labeled K4 in FIG. 11 may be assumed to equal to:

$$tK3+rJ4$$

wherein $tK3$ is the light transmitted from the vector labeled K3;

$t=1-r$ wherein r is the reflectivity of the material; and $rJ4$ is the light reflected from the vector labeled J4.

The use of glazing material instead of mirrors provides nearly seamless illusion of depth created by closely spaced reflections. The "infinity mirror" configuration does not easily allow for close proximity between the two mirrors as the displayed object is usually placed between the mirrors. Although it is possible to create apertures or cutout portions in a full mirror to create a display, such is difficult, costly and, in terms of design creation, beyond the ability of most lay people. Therefore, in order to produce this device, multiple sheets of glazing material are required for use rather than partial mirrors.

While the described methods and devices may be suitable for the particular purpose to which they address, they would not be as suitable for the purposes of the present invention as heretofore described.

SUMMARY OF THE INVENTION

The present invention relates in general to a method and device for producing a special effect and, more specifically, to a method of producing an illusion of thickness from a flat image viewable with the unaided eye and a device for producing an animated presentation viewable with the unaided eye having an illusion of thickness from the flat image.

A primary object of the present invention is to provide a method and device for producing an animated illusion that will overcome the shortcomings of prior art devices.

A further object is to provide a method and device for producing an animated illusion that can be used by untrained persons to easily and inexpensively create depth illusions of their own designs.

An even further object is to provide a method and device for producing an animated illusion for use by both amateur and professional artists in creating works of art or commercial displays, using a colorful, 3-dimensional, animated media.

Another object of the present invention is to provide a method and device for producing an animated illusion that is simple and easy to use.

A still further object of the present invention is to provide a method and device for producing an animated illusion that is economical in cost to manufacture.

Additional objects of the present invention will appear as the description proceeds.

The foregoing objects can be accomplished by providing a method and device comprising the following elements:

In the preferred embodiment, the viewing screen is a stack of thin sheets of glazing material. In front of the viewing screen is a device for reducing glare. At a rear portion of the screen frame is an integral slotted frame receptacle for holding the display media. The display media is preferably a rigid sheet of transparent material. The transparent material is overlaid with a black coating into which a design consisting of thin curvilinear apertures have been introduced around a central portion thereof. The direction of the apertures are always directed away from the center of the media. Immediately behind the display media is a motorized color wheel having dark opaque radial boundary lines separating light-transmitting colored sectors. The motion of the color wheel is controlled to rotate by a bi-directional motor having a timing mechanism regulating its rotation. An electric light source is located immediately behind the color wheel. The system is connected and controlled by conventional wiring and switches.

When the device is activated, the dark sector boundary lines in the color wheel moving against the cutout pattern in the artwork, produce a colorful pattern of line segments moving within the configuration of the design of the cutout pattern. When viewed through the aforementioned screen this pattern of moving illuminated line segments appears as a series of gradually fading, closely spaced reflections of the original cutout pattern. The produced visual effect is a pattern of virtually smooth, colorful surfaces separated by dark gaps that appear to project back as viewed from the position of the observer and from the original image perpendicular to the screen plane fading gradually into darkness. At the same time, the individual surface segments are seen to be undulating, changing color and length, while following each other along the fixed linear path of the original cutout design which circles or spirals into or away from the dark center of the screen (depending on both the configuration of the design and the direction in which the color wheel is being turned by the motor attached thereto). The depth of this effect is equal to or greater than the product of a constant of proportionality and the number of sheets in the screen.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become more fully appreciated as the same becomes better understood when considered in conjunction with the accompanying drawings, in which like reference characters designate the same or similar parts throughout the several views.

DESCRIPTION OF THE REFERENCED NUMERALS

Figure 1:
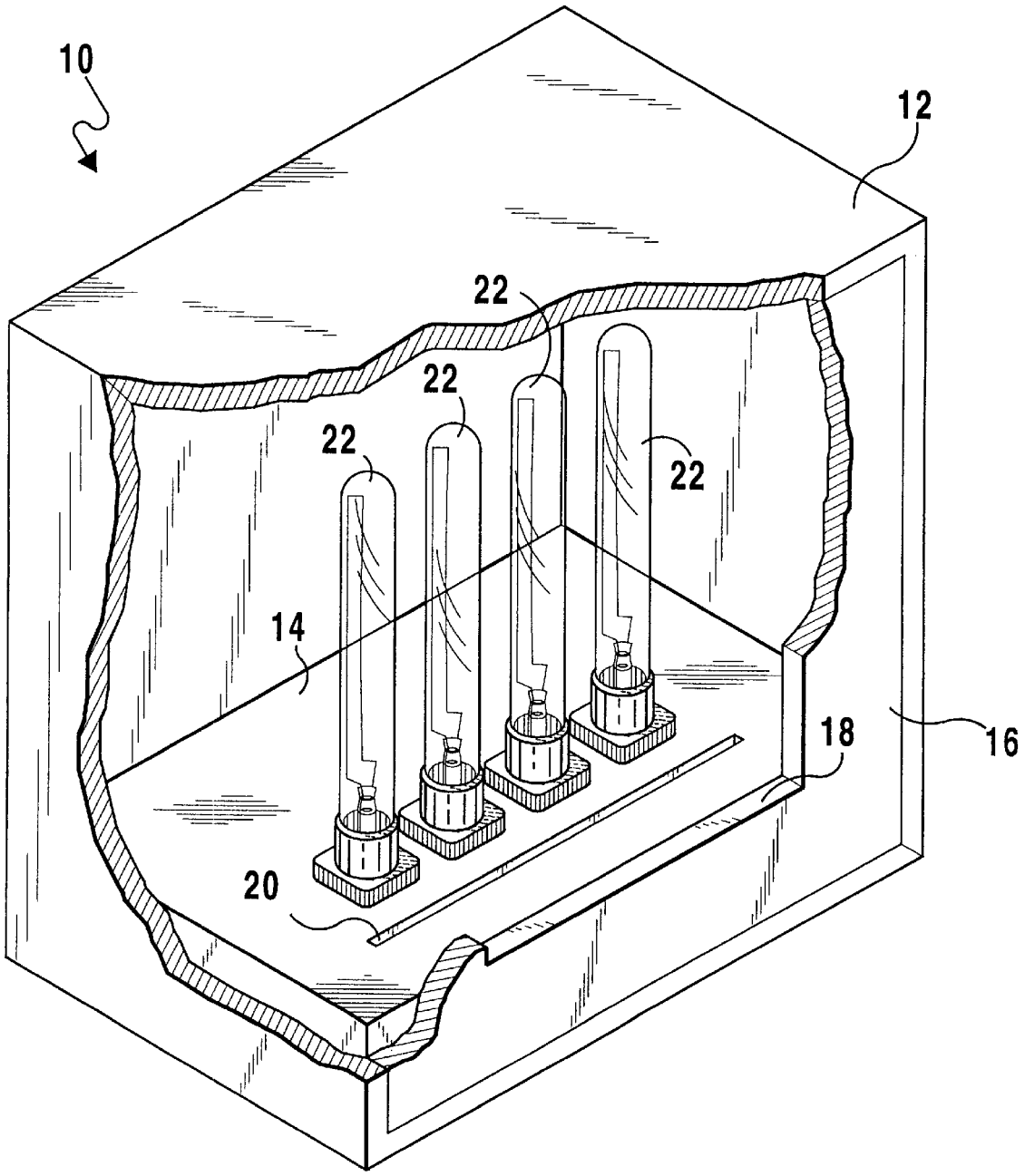
FIG. 1 is a top perspective view with parts cut away of the apparatus for creating an illusion of thickness from a flat image of the present invention at a preliminary stage of production.

Turning now descriptively to the drawings, in which similar reference characters denote similar elements throughout the several views, the Figures illustrate the method and apparatus for creating an illusion of thickness from a flat image of the present invention. With regard to the reference numerals used, the following numbering is used throughout the various drawing figures.

10 apparatus for creating an illusion of thickness from a flat image of the present invention

12 housing for containing apparatus for creating an illusion of thickness from a flat image of the present invention

14 base of housing

16 face side of housing

18 aperture cut into face side of housing

20 slot cut into base of housing

22 light source positioned within housing

24 color wheel

26 radial sector lines on color wheel

28 color sectors of color wheel separated by radial sector lines

30 rigid sheet of transparent acrylic

32 black surface laminated to rigid sheet of transparent acrylic

34 linear apertures cut into black surface

36 stack of acrylic sheets

38 one of the stack of acrylic sheets

40 dark lines appearing on stack of acrylic sheets

42 colored areas appearing on stack of acrylic sheets

44 arrow indicating direction of rotation of color wheel

46 arrow indicating apparent direction of rotation of dark lines and colored areas appearing on stack of acrylic sheets

48 viewing screen frame for holding stack of acrylic sheets

50 framed media holder for holding rigid sheet of transparent acrylic and color wheel to frame

52 gear for turning color wheel

54 motor for driving gear for turning color wheel

56 slot for holding rigid sheet of transparent acrylic

DETAILED DESCRIPTION OF THE PREFERRED EMBODIMENT

Turning now descriptively to the drawings, in which similar reference characters denote similar elements throughout the several views, FIGS. 1 through 9 illustrate the apparatus for creating an illusion of thickness from a flat image indicated generally by the numeral 10.

The apparatus for creating an illusion of thickness from a flat image 10 is shown in a partially assembled manner with parts cut away in FIG. 1 with FIGS. 2–4 and 6 illustrating the apparatus for creating an illusion of thickness from a flat image 10 at different stages of production. Illustrations of the apparatus for creating an illusion of thickness from a flat image 10 at different stages of production are provided to more fully illustrate the individual components of the apparatus.

As can be seen from FIG. 1 the apparatus for creating an illusion of thickness from a flat image 10 includes a housing 12 forming a hollow shell which contains the operating components of the apparatus for creating an illusion of thickness from a flat image 10 therein. The housing 12 includes an inside base 14 and a face side 16. Cut into the face side 16 is an aperture 18 for viewing into the housing 12. The aperture 18 is preferably square in shape although any shape aperture may be cut into the face side 16 as long as a viewer can see therethrough and into the housing 12. A slot 20 is cut into the base side 14 opening into the shell formed by the housing 12. Positioned within the shell formed by the housing 12 and connected to and extending from the base side 14 is at least one light source 22. In the preferred embodiment and illustrated in the figures a plurality of light sources are positioned within the shell formed by the housing 12. The light source 22 is preferably an array of commercially available light bulbs is positioned on a side of the slot 20 opposite the face side 16 and secured to the base 14 such that it provides sufficient light to produce the desired effects as will be described hereinafter. The slot 20 is positioned between the light source 22 and the aperture 18 and the light source 22 is located within the rear end of the shell formed by the housing 12 wherein it is the element closest to the back wall of the housing 12.

Figure 2:
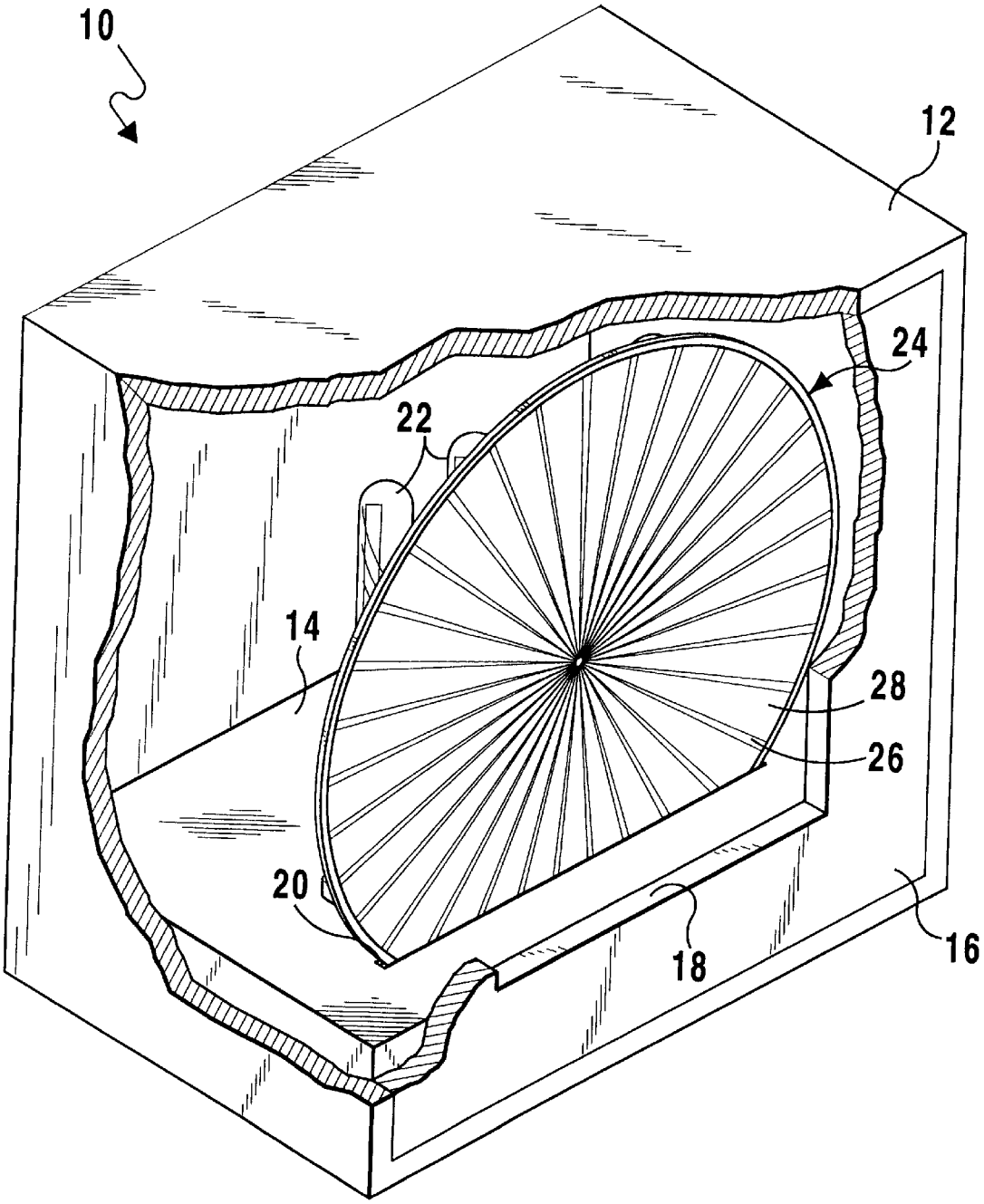
FIG. 2 is a top perspective view with parts cut away of a portion of the apparatus for creating an illusion of thickness from a flat image of the present invention at a stage of production advanced from that of FIG. 1.

As shown in FIG. 2, a color wheel 24 is positioned within the shell formed by the housing so as to partially extend into the slot 20. The color wheel 24 includes a plurality of radially extending sector lines 26 dividing the color wheel 24 into a plurality of color sectors 28. The sector lines 26 are preferably dark, opaque lines extending from the center of the color wheel 24. The sector lines 26 define the shape of the color sectors 28. The color sectors 28 are formed of light-transmitting material. The size of both the sector lines 26 and color sectors 28 may vary depending only on the effect desired by the viewer.

Figure 3:
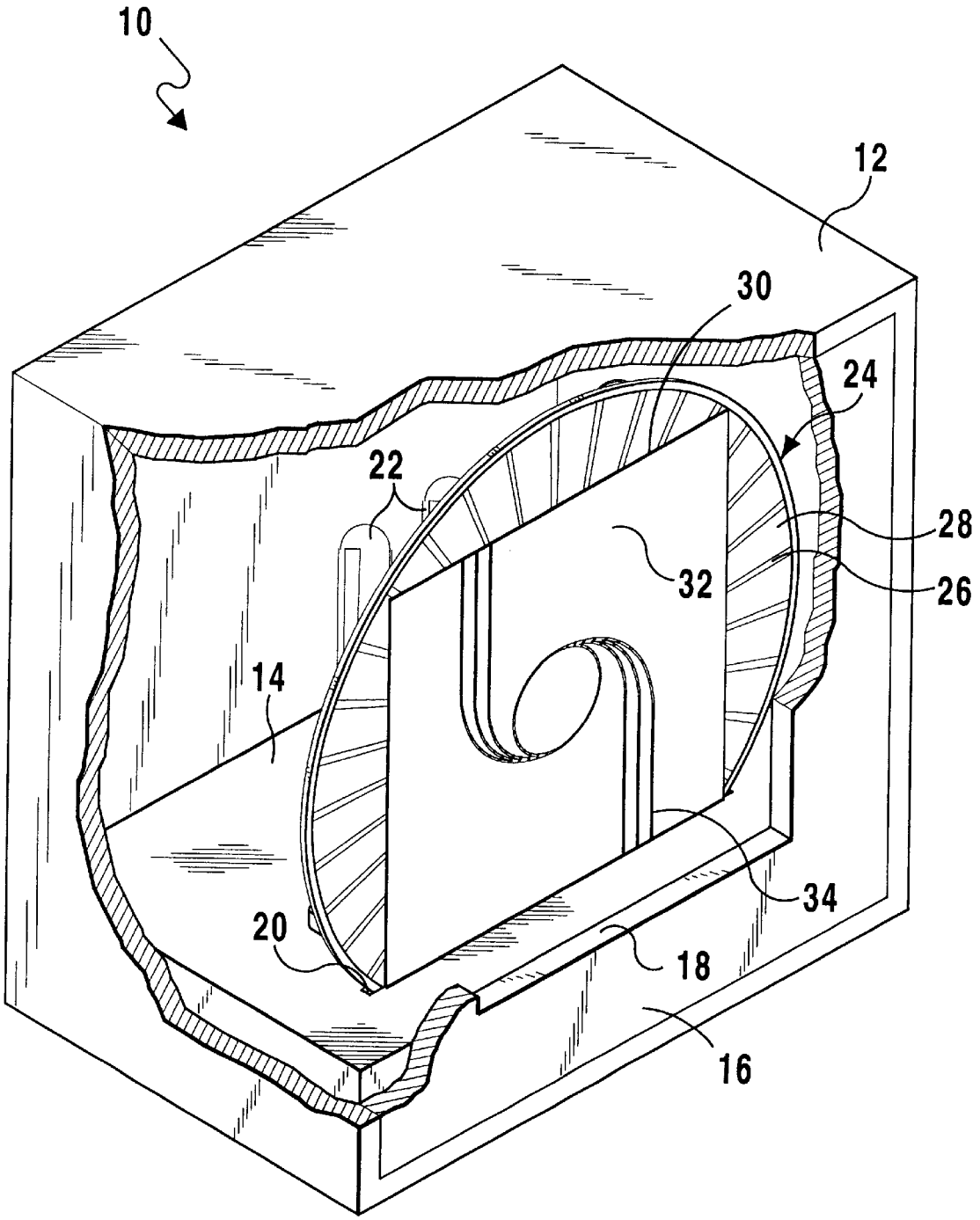
FIG. 3 is a top perspective view with parts cut away of a portion of the apparatus for creating an illusion of thickness from a flat image of the present invention at a stage of production advanced from that of FIG. 2.

The display media 30 is preferably a rigid square sheet of transparent acrylic laminated with black construction paper 32 into which a design of thin linear apertures 34 have been cutout around a central portion thereof, and which, in part, determines the configuration of display. A design cut into the display media 30 is illustrated in FIG. 3. Preferably, the design of said artwork is comprised of a configuration of thin lines, i.e. relative to the media area which are illuminated against a generally dark, opaque background and occupy a relatively small portion of the media. The orientation of the lines should be offset from the center of the media while progressing towards it to some degree but never meeting the center.

Figure 4:
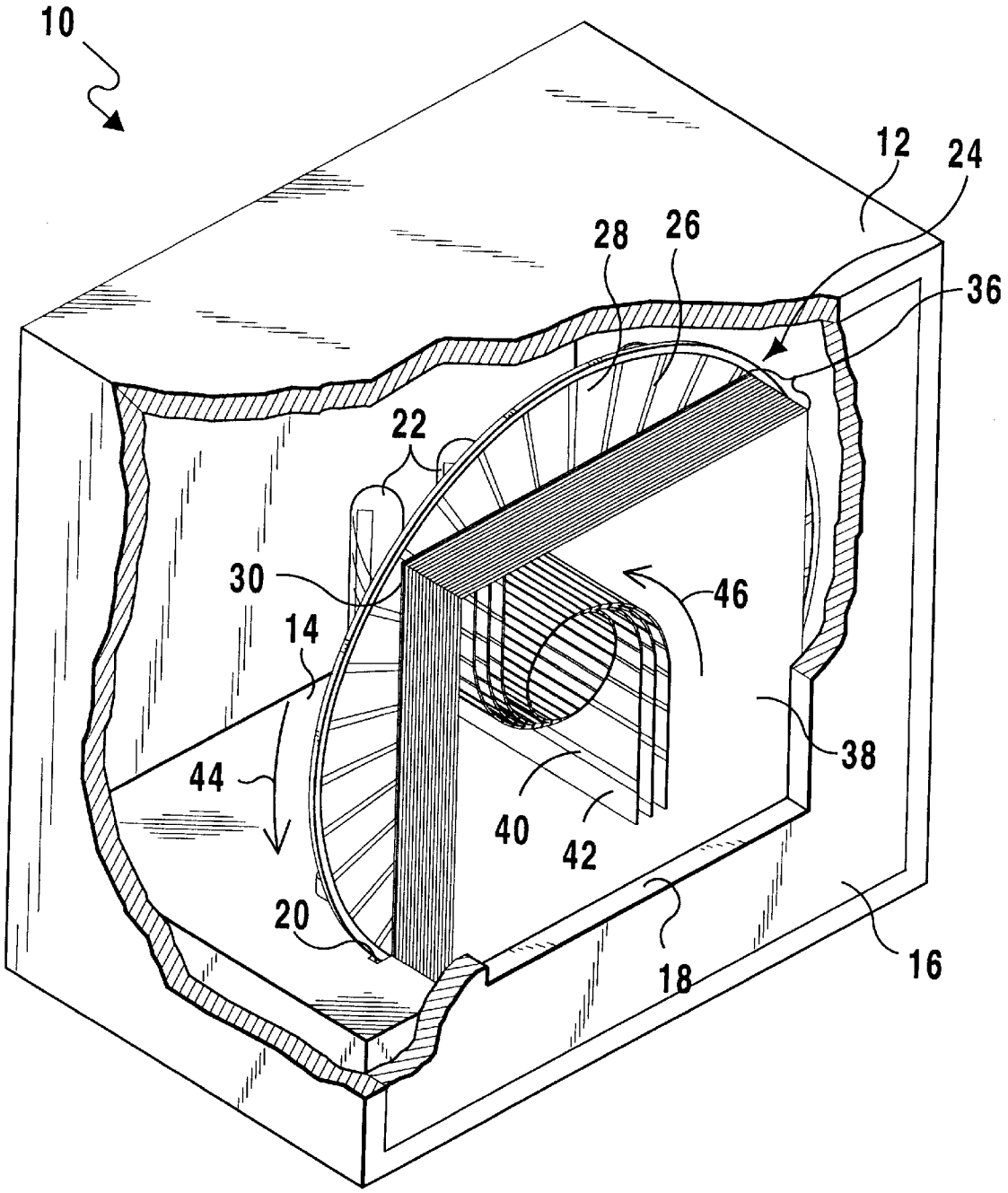
FIG. 4 a top perspective view with parts cut away of a portion of the apparatus for creating an illusion of thickness from a flat image of the present invention at a stage of production advanced from that of FIG. 3.
Figure 5:
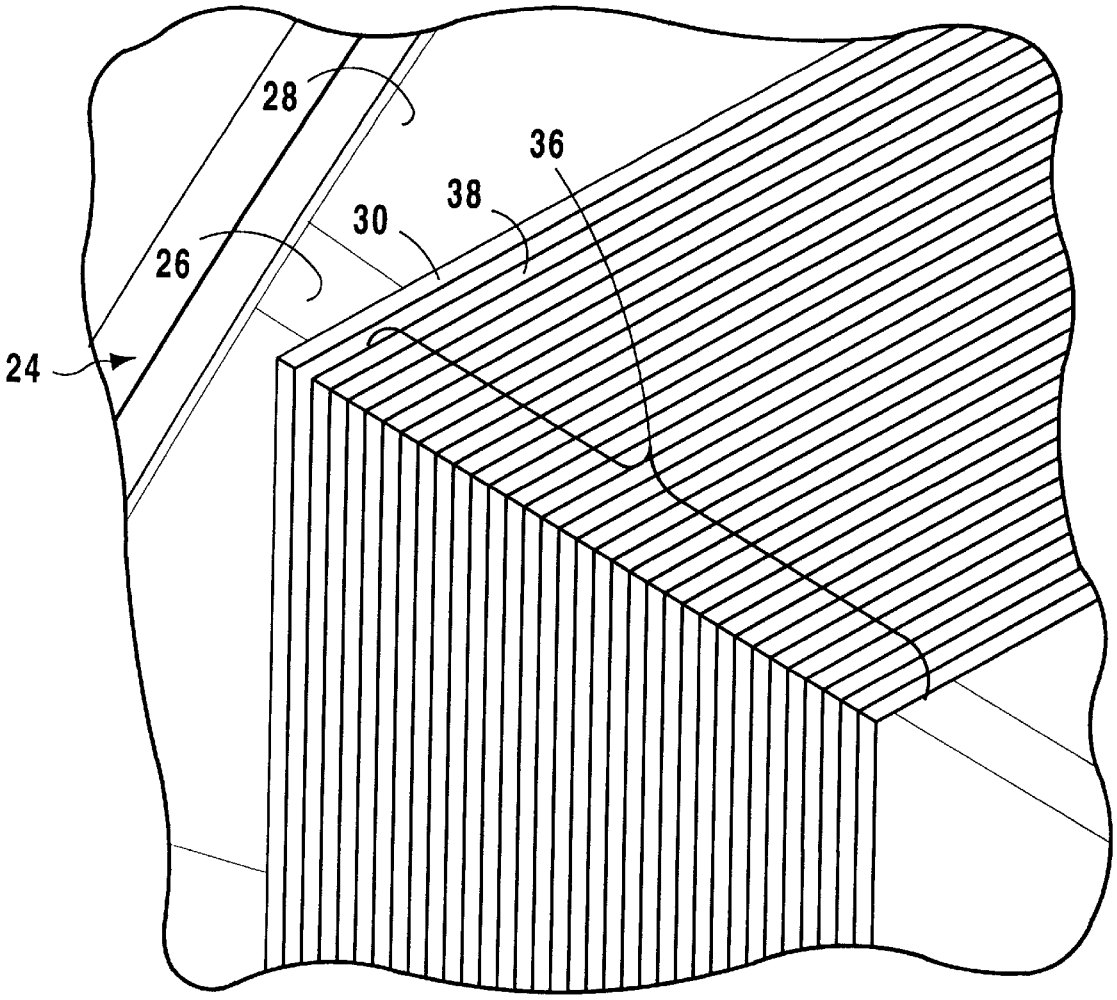
FIG. 5 is an enlarged top perspective view of the stack of sheets held within the frame and the display media of the apparatus for creating an illusion of thickness from a flat image of the present invention.

The plurality of glazing quality acrylic sheets 36 are illustrated in FIGS. 4 and 5 with a display media 30 positioned therebehind. The plurality of glazing quality acrylic sheets 36 are formed as a group of individual glazing quality acrylic sheets 38 As can be seen from this figure, the plurality of glazing quality acrylic sheets 36 are positioned in front of the color wheel 24 with the display media 30 positioned therebetween. When viewing the display media 30 through the plurality of glazing quality acrylic sheets 36 with the color wheel 24 positioned on the opposing side of the display media 30 a plurality of alternating dark lines 40 and colored areas 42 in the form of the design of thin linear apertures 34 cut into the display media 30 is viewed. When the color wheel 24 is turned in the direction indicated by the arrow labeled 44, the plurality of alternating dark lines 40 and colored areas 42 in the form of the design of thin linear apertures 34 cut into the display media 30 appears to rotate in the direction indicated by the arrow labeled 46.

Figure 6:
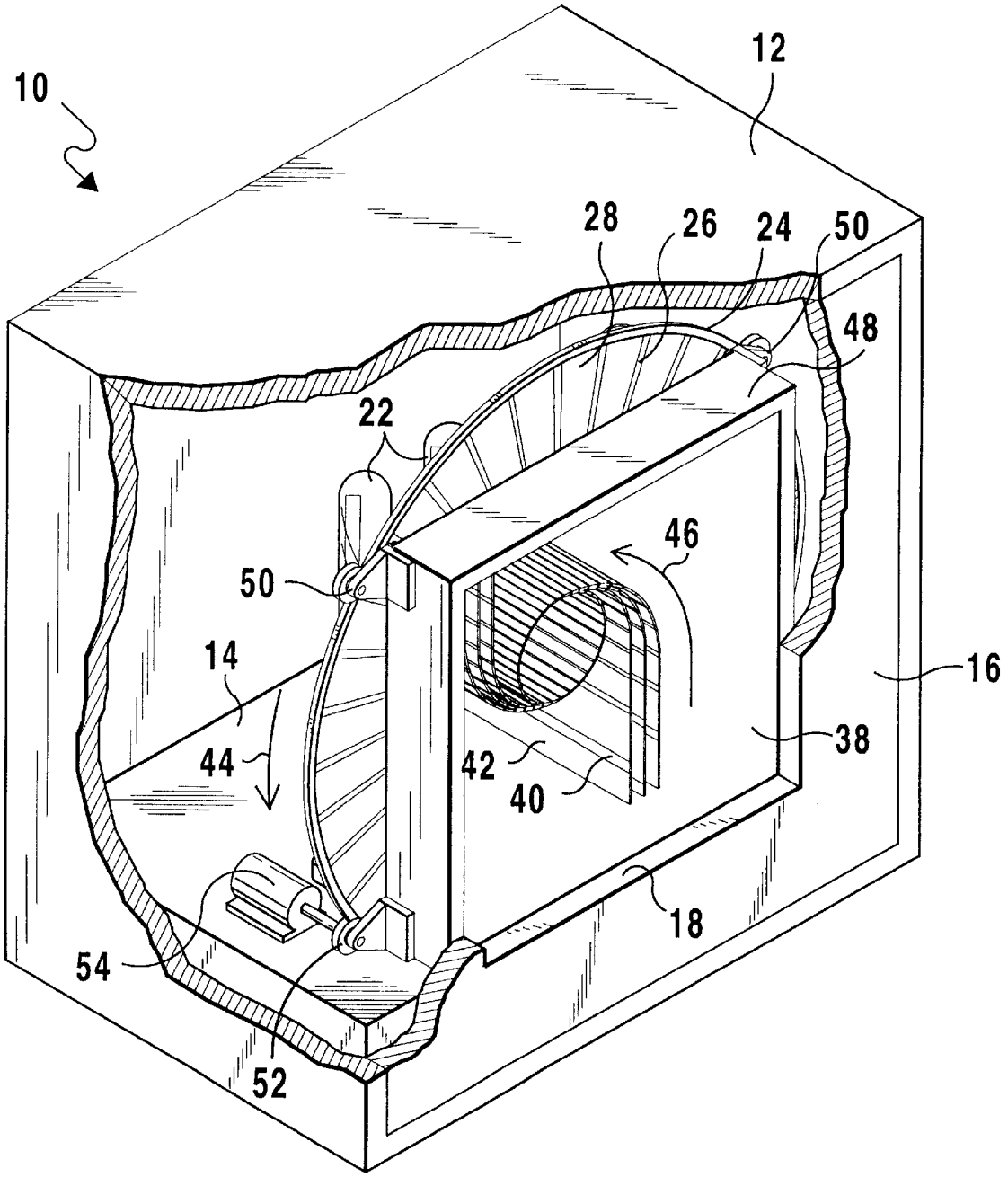
FIG. 6 is a top perspective view with parts cut away of a portion of the apparatus for creating an illusion of thickness from a flat image of the present invention at a stage of production advanced from that of FIG. 4.

FIG. 6 illustrates a viewing screen frame 48 secured to the base 14 and positioned between the color wheel 24 and the face side 16 within the shell formed by the housing 12. The viewing screen frame 48 is positioned so as to be framed by the aperture 18 cut into the front side 16 of the housing 12, thus the viewing screen frame 48 can be clearly seen when looking through the aperture 18. The viewing screen frame 48 houses the plurality of glazing quality acrylic sheets 36. Each of the glazing quality acrylic sheets 38 are preferably 1/16 inch thick and any number of individual glazing quality acrylic sheets 38 may be positioned within the viewing screen frame 48. Although any number of glazing quality acrylic sheets 38 may be used, in the preferred embodiment thirty-two of the glazing quality acrylic sheets 38 are positioned within the viewing screen frame 48. The use of an anti-glare substance or device (not shown) with the viewing screen is necessary to reduce outside reflections.

Figure 7:
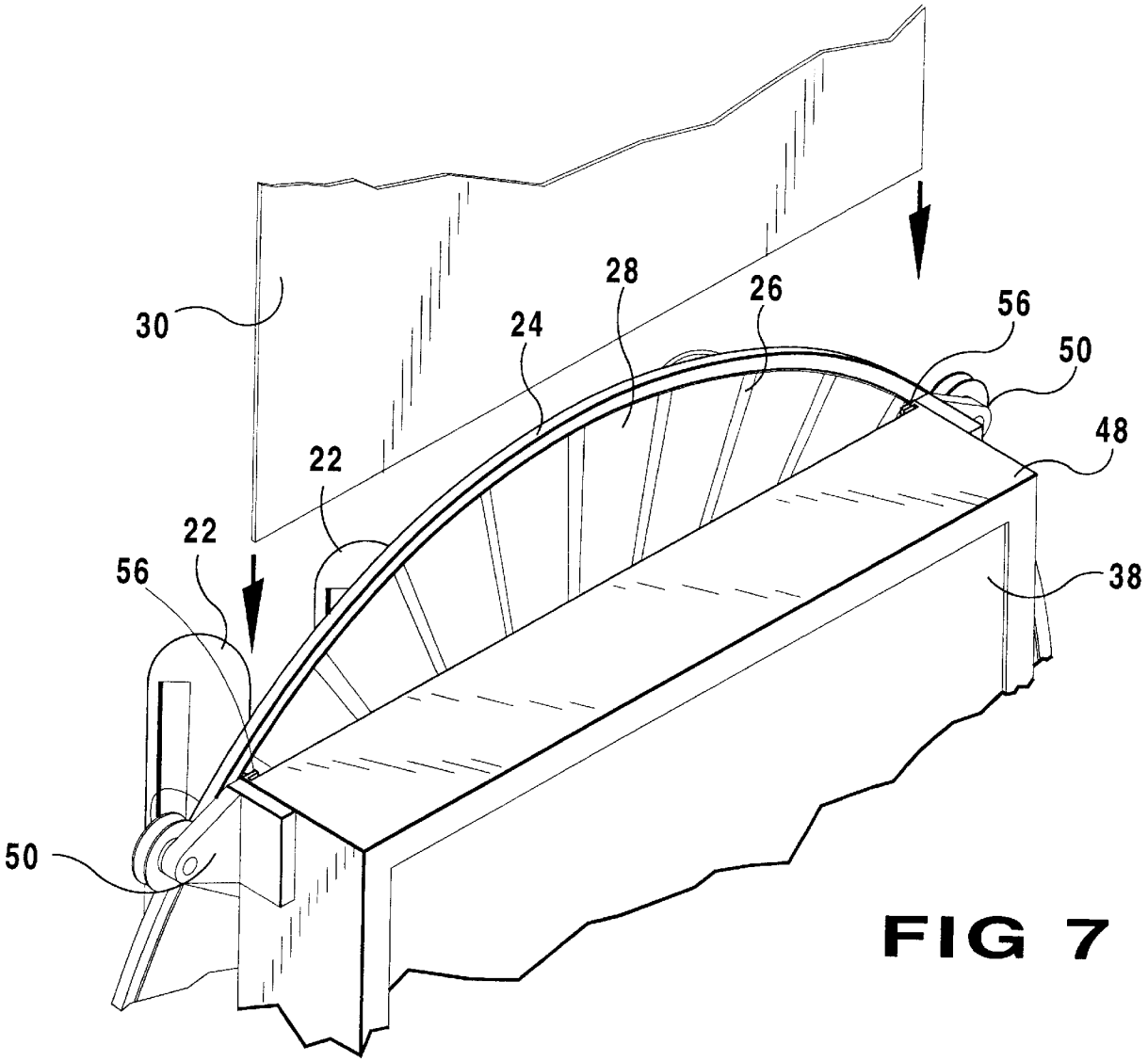
FIG. 7 is an enlarged top perspective view of a portion of the apparatus for creating an illusion of thickness from a flat image of the present invention.

Located directly behind, parallel to and centered within the viewing screen frame 48, is a slotted, framed media holder 50. FIG. 7 illustrates an exploded view of the framed media holder 50. The framed media holder 50 is integrally connected to the viewing screen frame 48 whereby the display media 30 and the color wheel 24 are held in place with respect to the plurality of glazing quality acrylic sheets 36 by the framed media holder 50. There are preferably four (4) of the framed media holders 50, one at each corner of the viewing screen frame 48. In the preferred embodiment of the invention, the framed media holder 50 forms a template holding slot 56 between the viewing screen frame 48 and the color wheel 24 which is open at the top to allow for changing display media 30 by sliding in and out as is indicated by the arrows illustrated in FIG. 7. The color wheel 24 is held in position by rotational gears 52 the framed media holders 50 and allowed to rotate therewith.

Secured to the base 14 of the housing 12 and connected to one of the rotational gears 52 of the framed media holder 50 is a frictional drive motor 54. The frictional drive motor 54 imparts rotation to the rotational gear 52 to which it is connected. The rotation imparted to the rotational gear 52 is then transferred to rotate the color wheel 24 in the opposing direction. This causes the plurality of alternating dark lines 40 and colored areas 42 in the form of the design of thin linear apertures 34 cut into the display media 30 to appear to rotate in the direction indicated by the arrow labeled 46.

Figure 8:
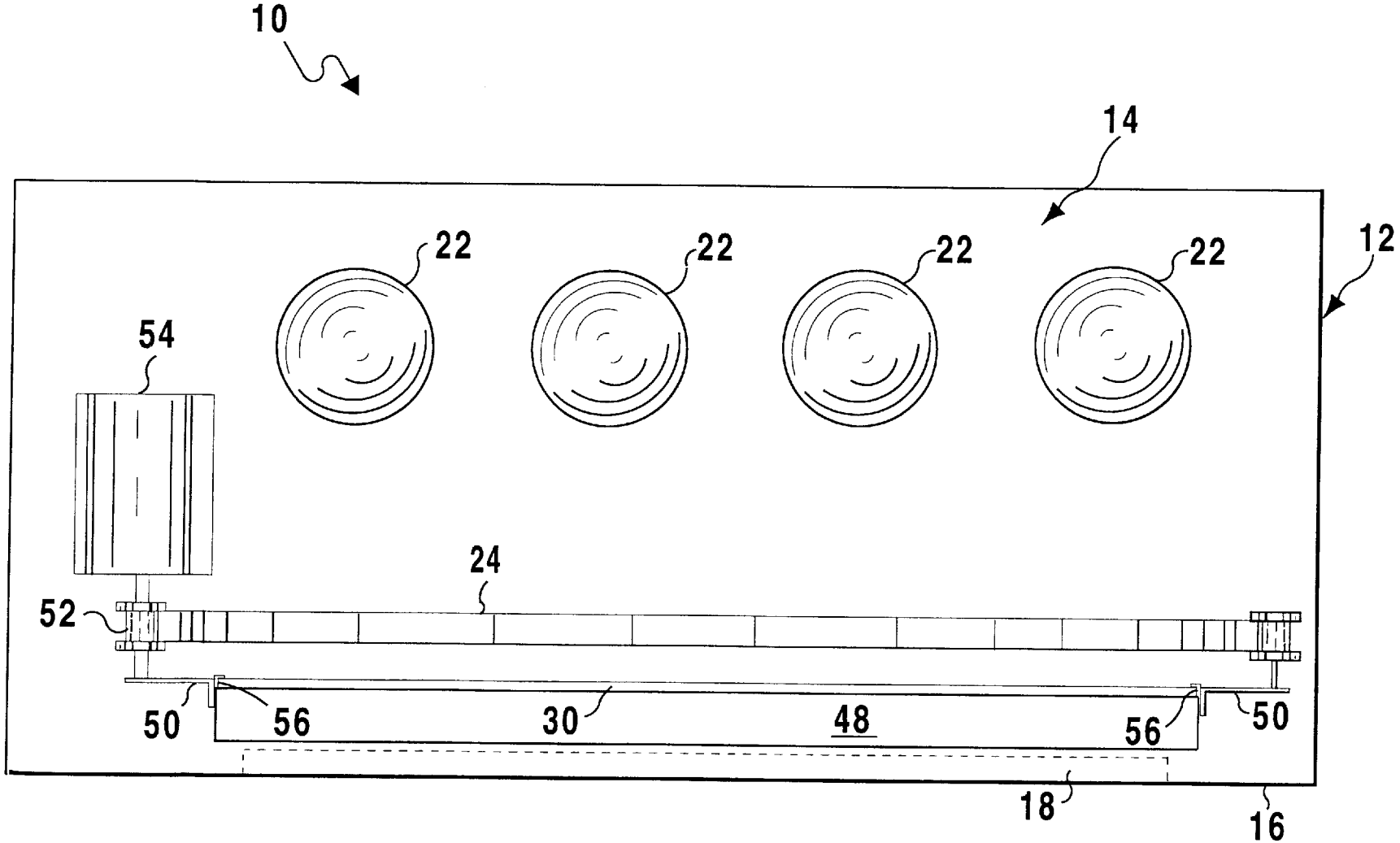
FIG. 8 is a top view of the apparatus for creating an illusion of thickness from a flat image of the present invention.
Figure 9:
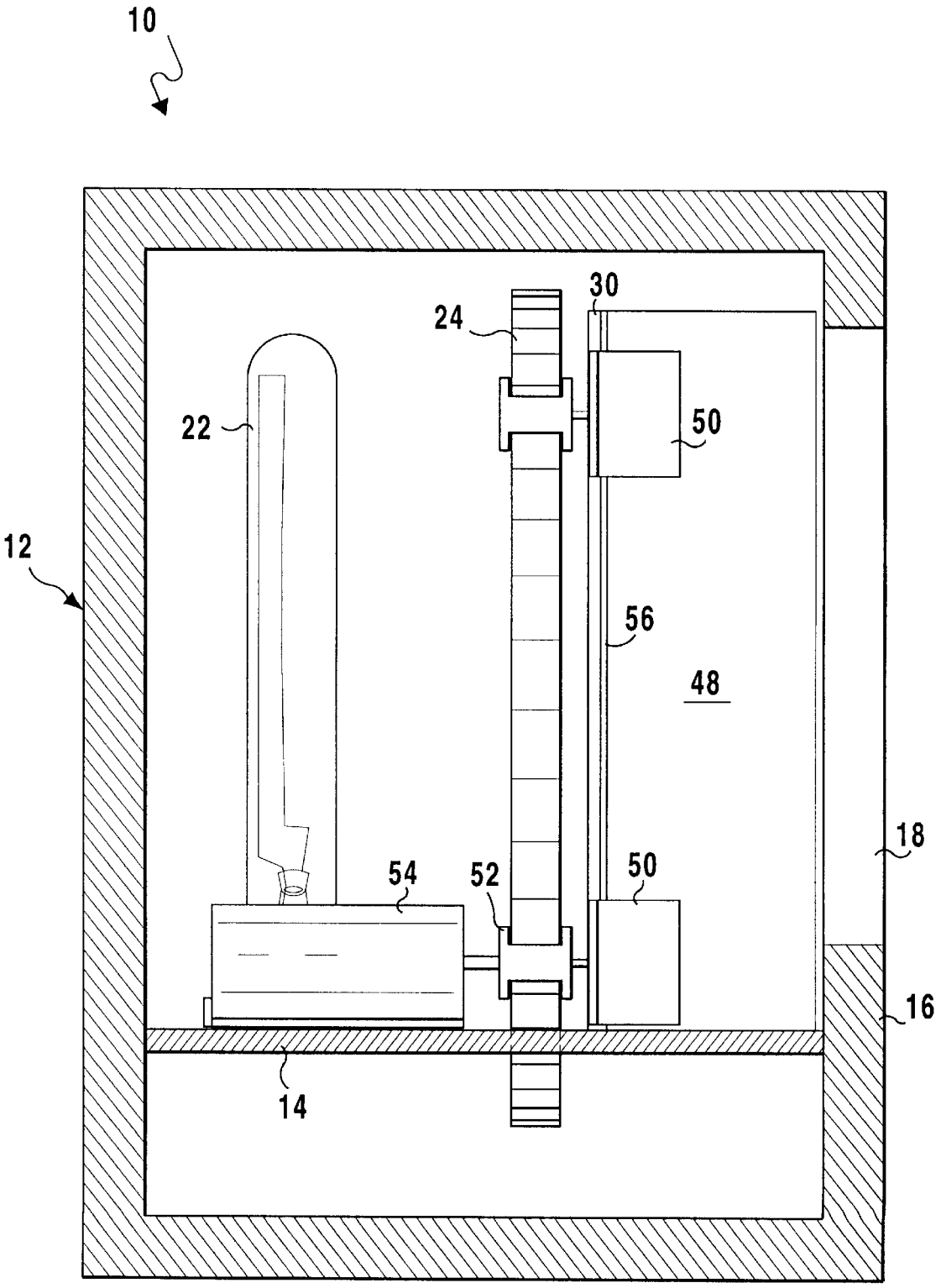
FIG. 9 is a side view of the apparatus for creating an illusion of thickness from a flat image of the present invention.

The relationship of each element in their position within the housing to one another can be clearly seen from both the top view illustrated in FIG. 8 and the side view illustrated in FIG. 9. As can be seen from these figures, the viewing screen frame 48 houses the plurality of glazing quality acrylic sheets 36 and is located between the aperture 18 in the face side 16 and the display media 30 which is held in position by the framed media holder 50. Directly behind the display media 30 is the color wheel 24 which is connected to and controlled to rotate by the motor 54. The color wheel is positioned to extend from the slot 20 within the base side 14 of the housing 12. The light source 22 is located behind the color wheel 24.

Rotation is transmitted to the color wheel 24 directly at its circumference by friction drive motor 54 via the rotational gear 52 connected therebetween. Due to the size and relationship of the color wheel 24 to the screen and base in the preferred embodiment, the lower portion of the color wheel 24 projects through slot 20 in the base 14.

The interposition of the sector lines 26 rotating against the linear cutout pattern cut into the display media 30 separates the lines into an ever changing pattern of undulating linear segments separated by dark gaps. When the plurality of glazing quality acrylic sheets 36 are placed within the viewing screen frame 48 and in front of this rotating, back lit assemblage, the original pattern is multiplied into a series of closely spaced, superimposed reflections by the matrix of reflective surfaces. These reflections are spaced so closely as to create the appearance of a pattern of virtually solid surfaces, separated by dark gaps. These gaps gives the final display its surface definition. The apparent surfaces are oriented at right angles to the screen while fading back into darkness. At the same time the pattern is seen to be circling or spiraling into or away from the dark center of the screen depending on both the configuration of the design and the direction in which the color wheel is turning.

Due to the design of the template and the counter-clockwise direction of rotation indicated by the arrow labeled 44 of the color wheel 24, the segmented surfaces appear to move in the same direction indicated by the arrow labeled 46, congruently along their planes, spiral inward and then revolve at some distance around the center of the screen. Reversing the rotation of the color wheel 24 creates the opposite illusion, i.e., of the surfaces moving congruently along their planes in the opposite direction and spiraling outward from the center.

Practicing the method of the present invention using varying numbers of sheets illustrates the multiplying effect of using multiple sheets by comparing the resulting pattern of singular term equations in a single sheet screen to multiple term pattern of the equations in the multiple sheet screen. It can be seen that the sum of the coefficients in each vector equation are the actual number of superimposed reflections present in each $R_i$ vector in FIG. 11.

The depth of the illusion, i.e. the visible range of these reflection series, is dependent upon several variables including: the number of reflective surfaces (assuming fixed high transparency/reflectivity ratio material), the color of the source light, the intensity of the light source and the ambient lighting and/or viewing conditions (including the amount of glare). Concatenating multiple sheets of glazing material has an augmenting effect due mostly to its high transparency/reflectivity ratio(as compared to that of partial mirrors) which allows for a more uniform distribution of light to be transmitted and reflected within the matrix at nearly 100% efficiency. Ignoring other factors, as the number of sheets increases, the visible range increases roughly in direct proportion while average brightness decreases. There comes a point at which the addition of sheets degrades the quality of the display due to effects of multiplying refraction and imperfections of individual sheets.

Repeated observations suggests that the number of the most prominently visible composite reflections generated by s number of sheets is, in fact, equal to s. FIG. 12 also reinforces this by showing pronounced decreases in the slopes of the fractional light function curves are found to appear at their respective sheet-number data points, e.g., at reflection #10 on the 10 sheet curve and at reflection #20 on the 20 sheet curve. Further confirmation of this relationship can be found by examining the vectors in FIG. 11 that start from reflection position $R_0$ and include every vector combination that ends at observer positions $R_1$, $R_2$, $R_3$ and $R_4$. The vectors within these composite reflection paths contain vectors with at least two reflections, i.e., a path containing at least two changes of direction to get from row "A" vectors to row "I" vectors ending at $R_4$ (4=number of sheets in screen in FIG. 11).

Figure 11:
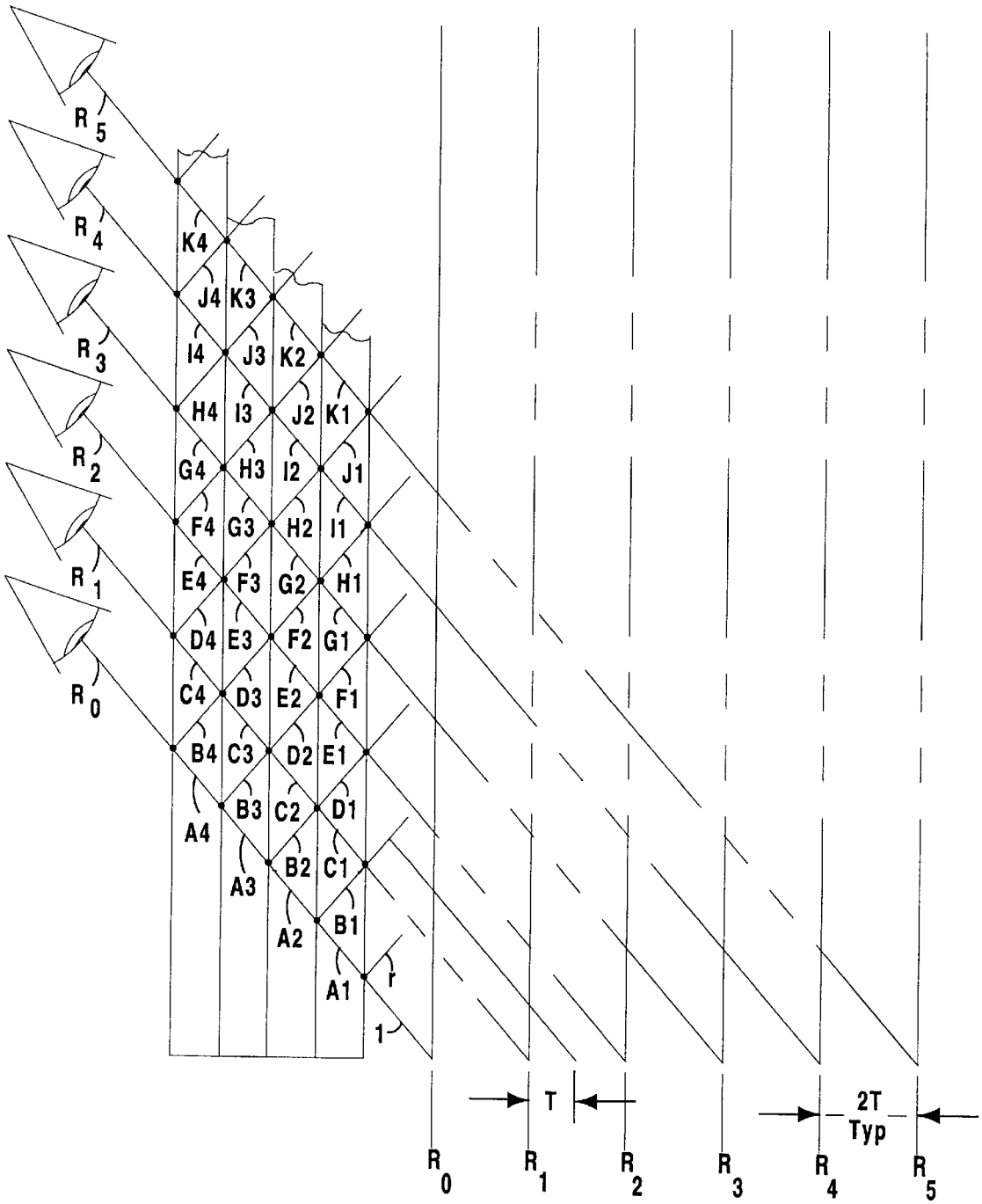
FIG. 11 is a graphical illustration of the incident light distribution pattern in a four sheet screen of the apparatus for creating an illusion of thickness from a flat image of the present invention.
Figure 12:
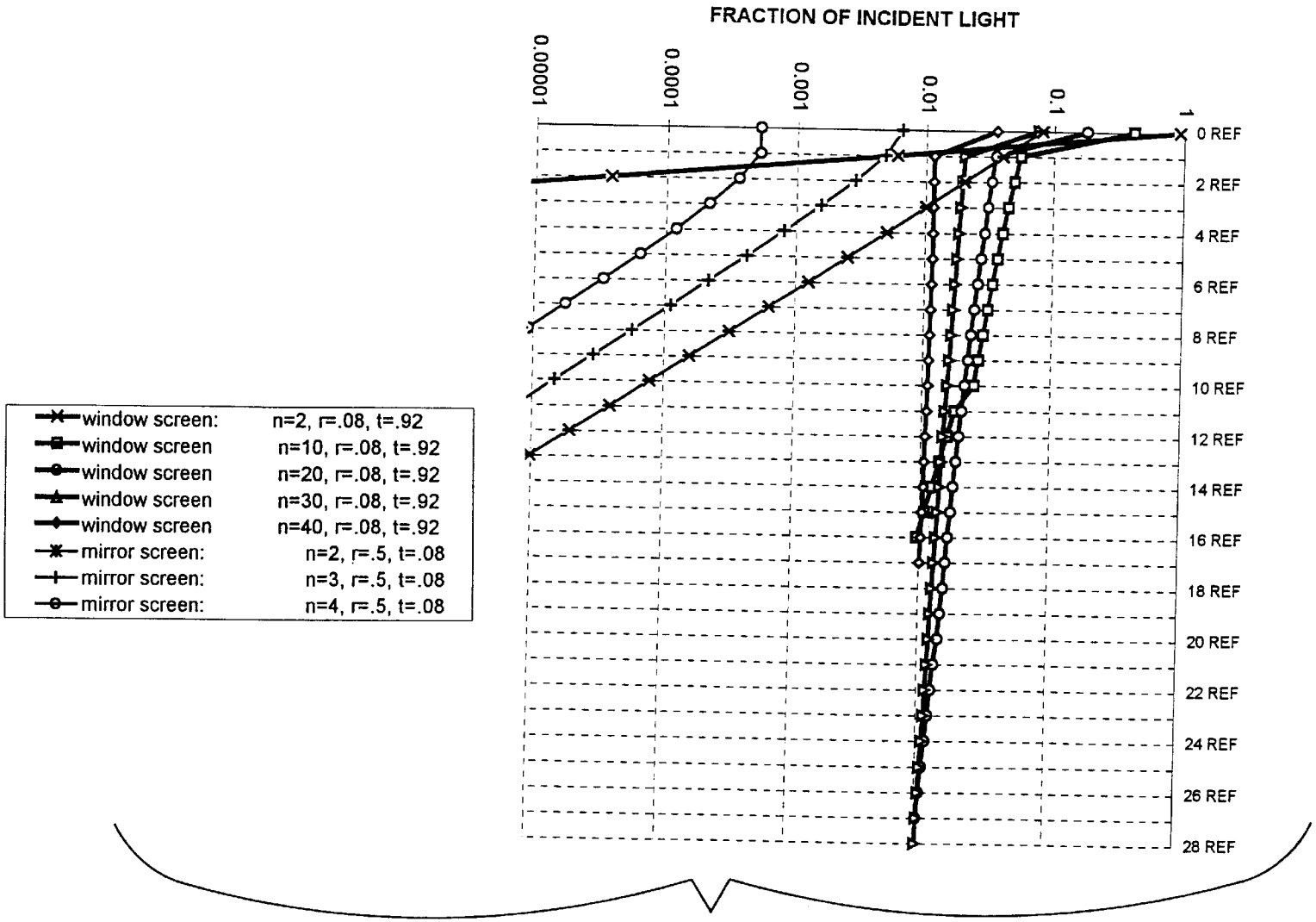
FIG. 12 is a graphical illustration of a comparison of visual ranges of infinity type screens vs. Window material type screens for screens including numbers of sheets ranging from 2 to 40.

All vectors illustrated in FIG. 11 that end at observer position greater than $R_4$ require four or more changes in direction from display position $R_0$. The additional reflections reduce the light from those positions significantly enough to cause the perception of a boundary condition, i.e., the end of the series. Therefore, it is reasonable to conclude that the last brightest composite reflection in the series will appear at position $R_s$ (s=number of sheets in the screen).

Figure 10:
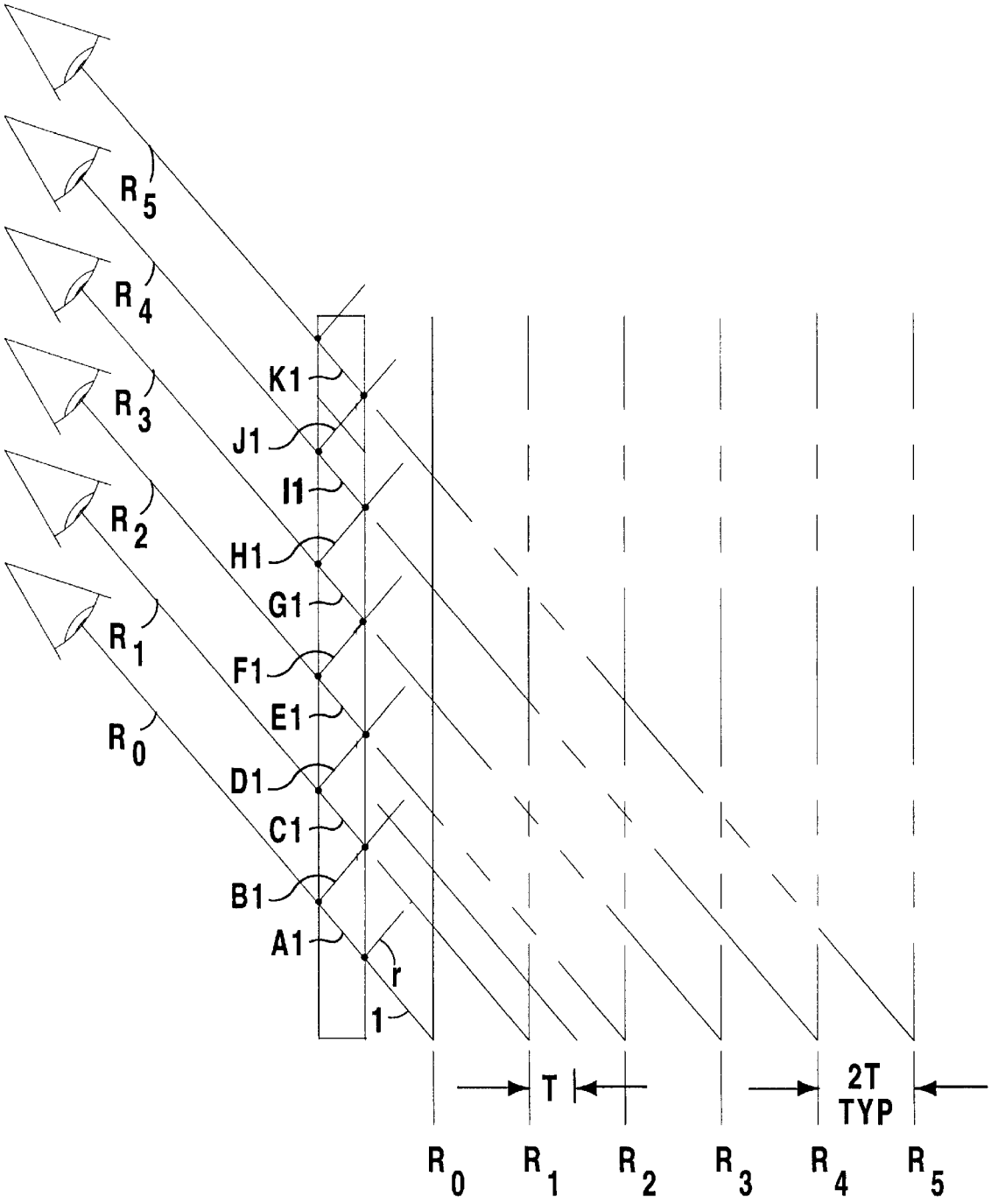
FIG. 10 is a graphical illustration of the incident light distribution pattern in a one sheet screen of the apparatus for creating an illusion of thickness from a flat image of the present invention.

As is illustrated in FIGS. 10 and 11, each receding reflection appears at equal intervals equal to twice the distance between the reflecting surfaces or 2T. If the maximum number of the most prominently visible reflections is s and thickness of each sheet is T (which is also the distance between reflecting surfaces), the thickness or depth of the reflection series is equal to or greater than $2 \times T \times s$.

If the intensity of the source light increases the perceived brightness and range will increase roughly in proportion to the log of the intensity (Weber-Fechner Law). Color also effects light intensity: towards the infrared end of the spectrum they are least intense and result in less than maximum number of visible reflections. Ambient lighting and viewing conditions also effect the resulting display inversely. The relatively small gaps between reflections creates the illusion of a nearly seamless projection of the original image, as if a solid extrusion of a cross section.

From the above description it can be seen that the method and device for producing an animated illusion of the present invention is able to overcome the shortcomings of prior art devices by providing a method and device for producing an animated illusion that can be used by untrained persons to easily and inexpensively create depth illusions of their own designs. The method and device for producing an animated illusion is made for use by both amateur and professional artists in creating works of art or commercial displays, using a colorful, 3-dimensional, animated media. Furthermore, the method and device for producing an animated illusion of the present invention is simple and easy to use and economical in cost to manufacture.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description but rather by the claims appended hereto.

What is claimed is new and desired to be protected by Letters Patent is set forth in the appended claims:

1. A method of producing an illusion of depth comprising the steps of:

a) forming a plurality of sheets into a stack for serving as a viewing screen, each sheet having a thickness based on a desired degree of smoothness of the illusion and an amount of said plurality of sheets equal to the desired depth of the illusion divided by twice the thickness of a typical one of the plurality of sheet;

b) selecting an amount of said plurality of sheets based upon said desired degree of smoothness of the illusion:

c) forming a gap between each of said plurality of sheets, a size of said gap being equal to the thickness of one of said plurality of sheets;

d) creating a design having at least one of relatively thin linear and curvilinear design elements on a design media capable of being illuminated by at least one of reflected and transmitted light, said design occupying a minority portion of the media, the remaining portion of the media providing a background; and e) illuminating said design with a light source having an empirically chosen intensity.

2. The method of producing an illusion of depth as defined in claim 1, further comprising the step of determining an amount of said plurality of sheets by dividing said desired depth of the illusion by 4 times the thickness of one of said plurality of sheets.

3. The method of producing an illusion of depth as defined in claim 2, further comprising the steps of forming a design of substantially opaque lines angularity offset with respect to the linear design on the design media on a display media; imparting bi-directional motion to one of the design and display media, wherein the substantially opaque lines of the design of the display media are separated by light transmitting portions; and arranging the display media substantially in line with the design media, wherein the arrangement produces a changing interference pattern creates an illusion of surfaces having depth with motion determined by the change in the interference pattern when viewed through the plurality of sheets.

4. The method of producing an illusion of depth as defined in claim 3, wherein the display media is in the form of a color wheel having opaque radial lines comprising a smaller portion of a total area of the color wheel and light transmitting colored sectors comprising a remaining portion thereof.

5. A device for producing an illusion of depth from a flat image, comprising:

a) a plurality of sheets, each of said sheets being at least partially transparent and reflective;

b) a light source;

c) a design media having at least one of relatively thin linear and curvilinear design elements cut therein positioned between the plurality of sheets and said light source;

d) a frame for holding said plurality of sheets therein and forming a slot therebehind for holding said design media, wherein illumination of said light source produces an illusion of depth for said at least one of relatively thin linear and curvilinear design elements cut into said design media; and e) a display media having a design of a plurality of substantially opaque lines angularity offset with respect to the linear design on the design media and positioned between said design media and said light source.

6. The device for producing an illusion of depth from a flat image as claimed in claim 5, further comprising means for imparting rotation to said display media.

7. The device for producing an illusion of depth from a flat image as claimed in claim 6, further comprising a housing including a face side having an aperture cut therein and a base side, said plurality of sheets, frame, design media, display media and light source being positioned atop said base side within said housing and being viewable through said aperture in said face side, said base side including a slot therein through which said display media extends.

8. The device for producing an illusion of depth from a flat image as claimed in claim 6, wherein said means for imparting rotation to said display media imparts bi-directional motion to said display media.

9. The device for producing an illusion of depth from a flat image as claimed in claim 8, wherein a gap exists between each of said plurality of sheets.

10. The device for producing an illusion of depth from a flat image as claimed in claim 9, wherein each of said plurality of sheets has a thickness and said gap between each of said plurality of sheets has a size equal to the illusory depth produce by the device multiplied by four times said thickness of each of said plurality of sheets.

11. The device for producing an illusion of depth from a flat image as claimed in claim 5, wherein each of said plurality of sheets are formed of glazing quality acrylic sheets.

12. The device for producing an illusion of depth from a flat image as claimed in claim 11, wherein each of said plurality of sheets has a thickness of 1/16 inch and said frame holds thirty two of said sheets.

13. The device for producing an illusion of depth from a flat image as claimed in claim 7, wherein said display media includes a plurality of light-transmitting color sectors defined by said plurality of substantially opaque lines.

14. The device for producing an illusion of depth from a flat image as claimed in claim 7, wherein the display media is in the form of a color wheel having opaque radial lines comprising a smaller portion of a total area of the color wheel and light transmitting colored sectors comprising a remaining portion thereof.

15. The device for producing an illusion of depth from a flat image as claimed in claim 7, wherein said design media is a rigid sheet of transparent material overlaid with a black coating.

16. The device for producing an illusion of depth from a flat image as claimed in claim 15, wherein said at least one of relatively thin linear and curvilinear design elements cut into said design media extend in a direction away from a center of said design media.

* * * * *